US012398633B2

(12) United States Patent
Watson et al.

(10) Patent No.: US 12,398,633 B2
(45) Date of Patent: Aug. 26, 2025

(54) HIGH PRESSURE RESISTANT AND PARTIAL DISCHARGE REDUCED MLE

(71) Applicant: Schlumberger Technology Corporation, Sugar Land, TX (US)

(72) Inventors: Arthur Ignatius Watson, Houston, TX (US); Shivam Kumar Singh, Lawrence, KS (US); Josh Brady, Lawrence, KS (US); Patrick Zhiyuan Ma, Lawrence, KS (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/652,584

(22) Filed: May 1, 2024

(65) Prior Publication Data

US 2024/0368970 A1 Nov. 7, 2024

Related U.S. Application Data

(60) Provisional application No. 63/499,320, filed on May 1, 2023.

(51) Int. Cl.
*E21B 43/12* (2006.01)
*E21B 17/02* (2006.01)

(52) U.S. Cl.
CPC ..... *E21B 43/128* (2013.01); *E21B 17/0285* (2020.05)

(58) Field of Classification Search
CPC ..... E21B 43/128; E21B 43/12; E21B 43/121
See application file for complete search history.

(56) References Cited

U.S. PATENT DOCUMENTS

| | | | | |
|---|---|---|---|---|
| 2009/0068037 | A1 | 3/2009 | Shaw et al. | |
| 2017/0018989 | A1* | 1/2017 | Reeves | F04D 13/086 |
| 2017/0244294 | A1* | 8/2017 | Holzmueller | H02K 5/132 |
| 2017/0350198 | A1* | 12/2017 | Ma | E21B 17/028 |
| 2018/0202271 | A1 | 7/2018 | Semple et al. | |
| 2019/0237900 | A1 | 8/2019 | Frey et al. | |
| 2020/0091652 | A1 | 3/2020 | Golberg | |
| 2022/0056767 | A1* | 2/2022 | Part | E21B 17/026 |

OTHER PUBLICATIONS

Schlumberger—Trident—Extreme conditions motor lead extension Accessed via wayback machine https://web.archive.org/web/20220121201713/https://www.slb.com/-/media/files/al/product-sheet/reda-maximus-trident-ps.ashx (Year: 2017).*

Schlumberger—Trident—Extreme conditions motor lead extension https://www.slb.com/products-and-services/innovating-in-oil-and-gas/completions/artificial-lift/power-systems-and-cables/trident-motor-lead-extension (Year: 2023).*

International Search Report and Written Opinion in corresponding PCT/US2024/027269 issued Aug. 19, 2024.

* cited by examiner

*Primary Examiner* — David Carroll
(74) *Attorney, Agent, or Firm* — Jeffrey D. Frantz

(57) ABSTRACT

An electric submersible pump (ESP) system. The ESP system may comprise a motor, a pothead coupled to the motor, and a cable coupled to the pothead via a motor lead extension (MLE) to provide power to the motor.

19 Claims, 3 Drawing Sheets

HIGH PRESSURE RESISTANT AND PARTIAL DISCHARGE REDUCED MLE

CROSS REFERENCE TO RELATED APPLICATIONS

The present application claims the benefit of U.S. Provisional Application No. 63/499,320, filed May 1, 2023, the entirety of which is incorporated by reference herein and should be considered part of this specification.

BACKGROUND

Various types of artificial lift equipment and methods are available, for example, electric submersible pumps (ESPs). An ESP includes multiple centrifugal pump stages mounted in series, each stage including a rotating impeller and a stationary diffuser mounted on a shaft, which is coupled to a motor. In use, the motor rotates the shaft, which in turn rotates the impellers within the diffusers. Well fluid flows into the lowest stage and passes through the first impeller, which centrifuges the fluid radially outward such that the fluid gains energy in the form of velocity. Upon exiting the impeller, the fluid flows into the associated diffuser, where fluid velocity is converted to pressure. As the fluid moves through the pump stages, the fluid incrementally gains pressure until the fluid has sufficient energy to travel to the well surface.

BRIEF DESCRIPTION OF THE FIGURES

Certain embodiments, features, aspects, and advantages of the disclosure will hereafter be described with reference to the accompanying drawings, wherein like reference numerals denote like elements. It is emphasized that, in accordance with standard practice in the industry, various features are not drawn to scale. In fact, the dimensions of various features may be arbitrarily increased or reduced for clarity of discussion. It should be understood that the accompanying figures illustrate the various implementations described herein and are not meant to limit the scope of various technologies described herein.

DETAILED DESCRIPTION

Figure 1:
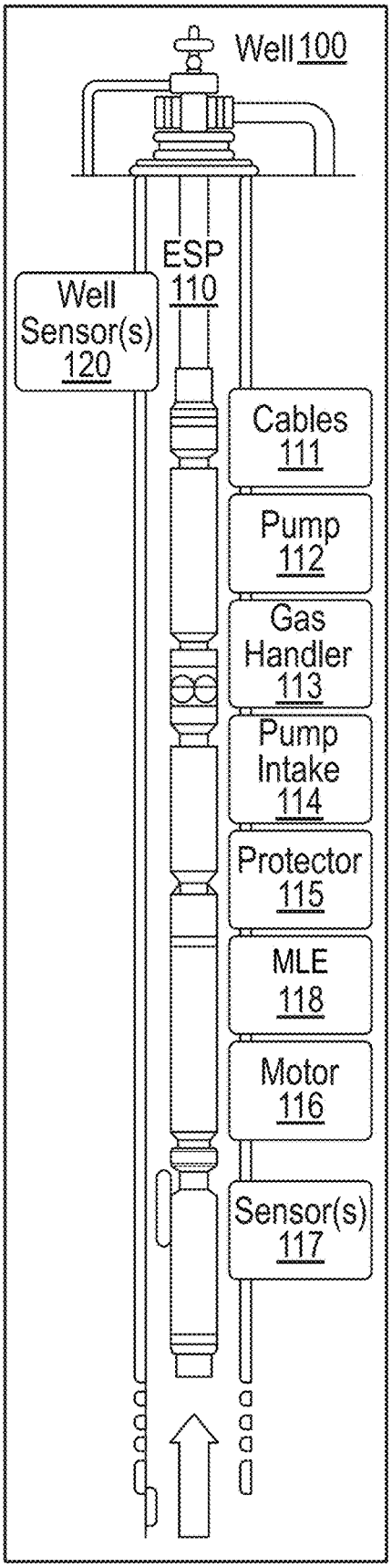
FIG. 1 is a schematic view of an electric submersible pump (ESP) system according to an embodiment of the disclosure.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Various types of artificial lift equipment and methods are available, for example, electric submersible pumps (ESP). As shown in the example embodiment of FIG. 1, an ESP 110 typically includes a motor 116, a protector 115, a pump 112, a pump intake 114, and one or more cables 111, which can include an electric power cable. The motor 116 can be powered and controlled by a surface power supply and controller, respectively, via the cables 111. In one or more embodiments, the power cables 111 are coupled to a pothead housing (e.g., pothead) via a motor lead extension (MLE) 118, as described in more detail below, which, in turn, is coupled to the motor 116. In some configurations, the ESP 110 also includes gas handling features 113 and/or one or more sensors 117 (e.g., for temperature, pressure, current leakage, vibration, etc.). As shown, the well 100 may include one or more well sensors 120.

Figure 2:
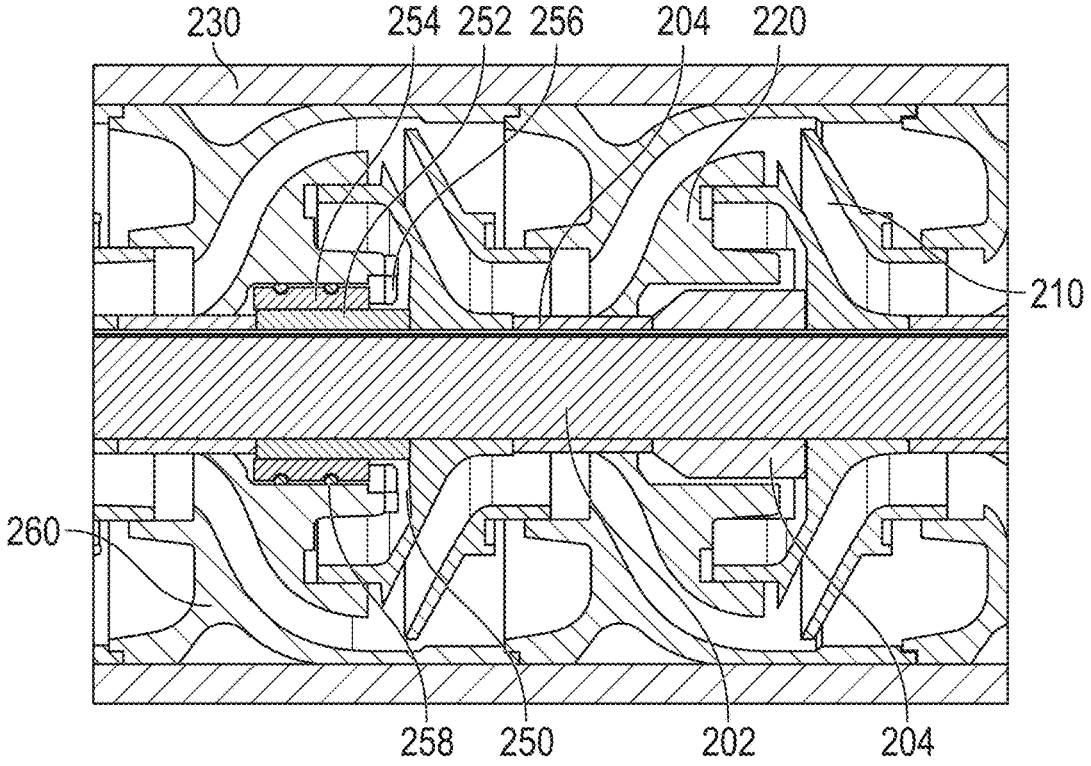
FIG. 2 is a cross-sectional view of the pump the ESP of FIG. 1.

The pump 112 includes multiple centrifugal pump stages mounted in series within a housing 230, as shown in FIG. 2. Each stage includes a rotating impeller 210 and a stationary diffuser 220. One or more spacers 204 can be disposed axially between sequential impellers 210. A shaft 202 extends through the pump 112 (e.g., through central hubs or bores or the impellers 210 and diffusers 220) and is operatively coupled to the motor 116. The shaft 202 can be coupled to the protector 115 (e.g., a shaft of the protector), which in turn can be coupled to the motor 116 (e.g., a shaft of the motor). The impellers 210 are rotationally coupled, e.g., keyed, to the shaft 202. The diffusers 220 are coupled, e.g., rotationally fixed, to the housing 230. In use, the motor 116 causes rotation of the shaft 202 (for example, by rotating the protector 115 shaft, which rotates the pump shaft 202), which in turn rotates the impellers 210 relative to and within the stationary diffusers 220. The pump 112 may comprise an endplay gap 250, a bearing sleeve or shaft sleeve 252, a radial bearing or bushing 254, a lock ring and/or upthrust ring 256, a compliant mount elastomer ring or o-ring 258, and a bearing housing diffuser 260.

In use, well fluid flows into the first (lowest) stage of the ESP 110 and passes through an impeller 210, which centrifuges the fluid radially outward such that the fluid gains energy in the form of velocity. Upon exiting the impeller 210, the fluid makes a sharp turn to enter a diffuser 220, where the fluid's velocity is converted to pressure. The fluid then enters the next impeller 210 and diffuser 220 stage to repeat the process. As the fluid passes through the pump stages, the fluid incrementally gains pressure until the fluid has sufficient energy to travel to the well surface.

Figure 3:
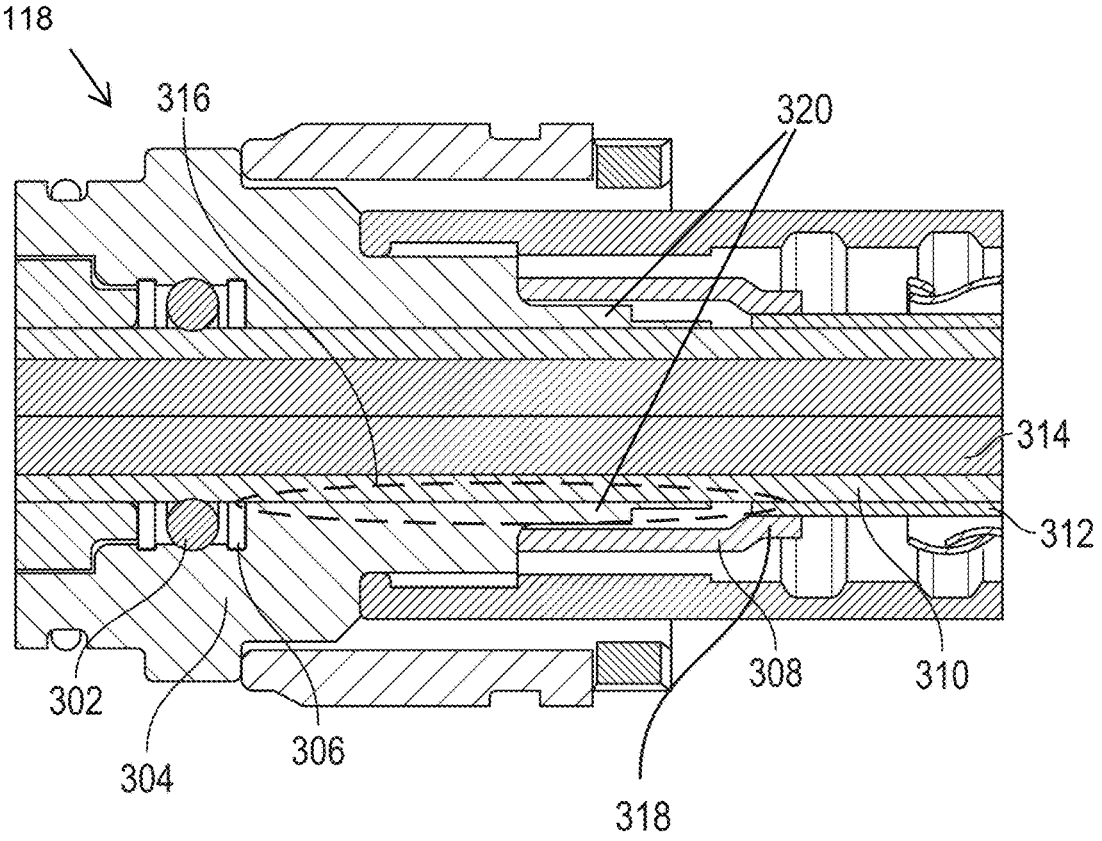
FIG. 3 is a schematic view of a motor lead extension (MLE) according to an embodiment of the disclosure.

Turning now to FIG. 3, FIG. 3 is a motor lead extension (MLE) 118 for High Pressure applications. The MLE 118 may comprise an O-ring 302, pothead housing 304 (e.g., pothead), backup ring 306, solder joint 308, insulation (e.g., PEEK) 310, lead portion 312, copper portion 314 (e.g., cable or cable portion), and a location of oil 316 within pothead housing 304. A pressure differential can break the barrier in an MLE 118 and cause it to fail. Partial discharge failure is a common failure mode for devices which are subject to high electrical voltage. This application includes the introduction of a dielectric oil that reduces the likelihood of PD (Partial Discharge) in the pothead housing 304 as well as providing the needed additional support to the Solder Joint required due to the high-pressure differential across the joint. Before soldering the lead and pothead housing 304 together, a seal will be created behind (e.g., on the backside of) the pothead housing 304, to contain the oil. After the injection of oil using a special tool, the oil will reside in the clearance gap between the insulation and the pothead housing 304 and between the backup ring and the solder joint. An area of importance is shown by the dotted-oval area in FIG. 3.

Figure 4:
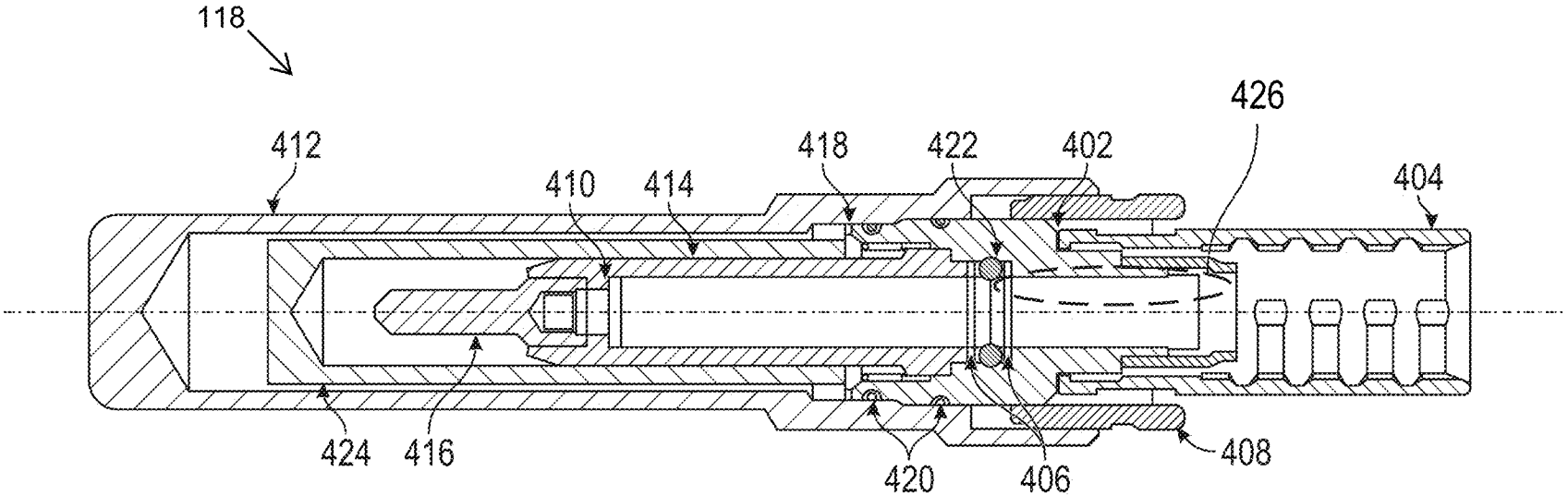
FIG. 4 is another schematic view of an MLE according to an embodiment of the disclosure.

FIG. 4 shows another motor lead extension (MLE) 118 for High Pressure applications. The MLE 118 may comprise O rings 406, 422, elements 412, 424, 416, 410, 414, 418, 420, 402, 408, 404, and location of oil within pothead housing 426 (e.g., pothead). The oil is held in place by the seal on the top of the insulation 310 and below the flared end 318 of the lead barrier 312 (also known as lead layer 312). This flared area will then go around the outside of the pothead housing tail 320 and will be soldered to complete the metal-to-metal seal. The seal and the internal O-ring contain the oil and prevent it from penetrating throughout the length of the lead layer. Once the MLE 118 experiences increased pressure the compression will start to compress the lead layer and provide another barrier to stop the oil from penetrating, as shown in FIG. 4.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. An electric submersible pump (ESP) system, the ESP system comprising:
   a motor; and
   a motor lead extension (MLE) coupled to the motor, wherein the MLE comprises a pothead, a cable configured to provide power to the motor, and a dielectric oil that reduces a likelihood of a partial discharge (PD) in the pothead, wherein the dielectric oil is disposed in a clearance gap within the pothead.

2. The ESP system of claim 1, wherein the dielectric oil is configured to provide support to a solder joint.

3. The ESP system of claim 1, comprising a seal located behind the pothead, the seal at least partially containing the dielectric oil.

4. The ESP system of claim 1, comprising insulation disposed about the cable within the pothead, wherein the dielectric oil is disposed in the clearance gap radially between the pothead and the insulation.

5. The ESP system of claim 1, wherein the MLE is configured to house the dielectric oil in the clearance gap axially between a backup ring and a solder joint.

6. The ESP system of claim 1, comprising a seal, an insulation, and a flared end of a lead barrier, wherein the seal is configured to hold the dielectric oil in place on a top of the insulation and below the flared end of the lead barrier.

7. The ESP system of claim 1, wherein a flared end of a lead barrier is positioned radially on top of a pothead housing tail of the pothead housing and affixed thereto in order to create a metal-to-metal seal.

8. The ESP system of claim 1, comprising a seal and an internal O-ring, wherein the seal and the internal O-ring are configured to house the dielectric oil and prevent the dielectric oil from penetrating throughout a length of a lead layer.

9. The ESP system of claim 1, wherein the MLE is configured to, when the MLE experiences increased pressure, compress a lead layer and provide a barrier to stop the dielectric oil from discharging.

10. A method comprising:
   disposing an electric submersible pump (ESP) system within a wellbore; and
   operating the ESP system via power provided to a motor of the ESP system via a motor lead extension (MLE) coupled to the motor, wherein the MLE comprises a pothead, a cable configured to provide the power to the motor, and a dielectric oil that reduces a likelihood of a partial discharge (PD) in the pothead, wherein the dielectric oil is disposed in a clearance gap within the pothead.

11. The method of claim 10, comprising providing support to a solder joint via the dielectric oil.

12. The method of claim 10, comprising containing the dielectric oil via a seal located behind the pothead.

13. The method of claim 10, comprising housing an insulation disposed about the cable within the pothead, wherein the dielectric oil is disposed in the clearance gap radially between the pothead and the insulation.

14. The method of claim 10, comprising housing, by the MLE, the dielectric oil in the clearance gap axially between a backup ring and a solder joint.

15. The method of claim 10, comprising holding, by a seal, the dielectric oil in place on a top of an insulation and below a flared end of a lead barrier.

16. The method of claim 10, comprising creating a metal-to-metal seal via a flared end of a lead barrier that is positioned around an outside of a pothead housing tail and affixed thereto.

17. The method of claim 10, comprising housing, by a seal and an internal O-ring, the dielectric oil and preventing the dielectric oil from penetrating throughout a length of a lead layer.

18. The method of claim 10, comprising compressing, by the MLE, when the MLE experiences increased pressure, a lead layer and providing a barrier to stop the dielectric oil from discharging.

19. The ESP system of claim 1, wherein the MLE is directly coupled to the motor.

* * * * *